US009498055B2

(12) United States Patent
Distefano

(10) Patent No.: US 9,498,055 B2
(45) Date of Patent: Nov. 22, 2016

(54) PORTABLE TRAY FOR LUGGAGE

(71) Applicant: John C. Distefano, Chesterfield, MO (US)

(72) Inventor: John C. Distefano, Chesterfield, MO (US)

( * ) Notice: Subject to any disclaimer, the term of this patent is extended or adjusted under 35 U.S.C. 154(b) by 0 days.

(21) Appl. No.: 14/920,861

(22) Filed: Oct. 22, 2015

(65) Prior Publication Data

US 2016/0113388 A1 Apr. 28, 2016

Related U.S. Application Data

(60) Provisional application No. 62/066,986, filed on Oct. 22, 2014.

(51) Int. Cl.

| | |
|---|---|
| ***A45C 13/28*** | (2006.01) |
| ***A47B 5/04*** | (2006.01) |
| ***A47B 13/08*** | (2006.01) |

(52) U.S. Cl.

CPC ..... *A47B 5/04* (2013.01); *A45C 13/28* (2013.01); *A47B 13/081* (2013.01); *A47B 13/088* (2013.01)

(58) Field of Classification Search

CPC .... A47B 5/04; A47B 13/081; A47B 13/088; A45C 13/28; A45C 9/00; A45C 13/26

USPC ..... 108/41, 42

See application file for complete search history.

(56) References Cited

U.S. PATENT DOCUMENTS

| | | | | |
|---|---|---|---|---|
| 6,390,431 | B1 | 5/2002 | Ott | |
| 6,471,019 | B1 | 10/2002 | Miller | |
| 6,604,472 | B2 | 8/2003 | McNeil | |
| 6,736,073 | B2 | 5/2004 | Ryburg | |
| D492,486 | S | 7/2004 | Mullins | |
| 7,350,857 | B2 * | 4/2008 | Bishop | A45C 9/00 190/8 |
| 7,510,157 | B2 | 3/2009 | Oliver | |
| 7,987,955 | B2 | 8/2011 | Puchalski | |
| 8,235,190 | B2 | 8/2012 | Porte | |
| 8,307,966 | B2 | 11/2012 | Cummins | |
| 8,485,327 | B1 | 7/2013 | Dalrymple | |
| 8,613,349 | B1 * | 12/2013 | Halko | A45C 9/00 190/11 |
| 8,662,267 | B1 * | 3/2014 | Hart | A45C 5/14 190/1 |
| 2002/0178972 | A1 * | 12/2002 | McNeil | A45C 13/00 108/42 |
| 2005/0098402 | A1 | 5/2005 | Cohen | |
| 2005/0150733 | A1 * | 7/2005 | Chen | A45C 13/262 190/115 |
| 2006/0022006 | A1 | 2/2006 | Cruise | |
| 2006/0219745 | A1 | 10/2006 | Riley | |
| 2007/0158156 | A1 * | 7/2007 | Chen | A45C 5/14 190/11 |
| 2010/0187062 | A1 | 7/2010 | Sweeney | |
| 2011/0209960 | A1 * | 9/2011 | MacLean, III | A45C 5/14 190/18 A |
| 2012/0325607 | A1 * | 12/2012 | Webster | A45C 5/143 190/115 |

(Continued)

*Primary Examiner* — Daniel Rohrhoff

(74) *Attorney, Agent, or Firm* — Charles McCloskey

(57) ABSTRACT

A portable tray for luggage has a support assembly, a ratchet assembly, a table, and a storage sleeve. The support assembly installs upon the telescoping poles of an existing handle assembly of luggage. The support assembly then allows a user to position the invention at a desired elevation from a supporting surface such as a concourse floor. The ratchet assembly allows a user to rotate the table from a stowed position, generally within the poles of a handle assembly, to a cantilevered position across the top of a piece of luggage. The user then unfolds the table of three plates into a flat shape, generally level but with at least two alternate angles. The invention fits into a storage sleeve placed within the handle assembly and within the luggage. The storage sleeve prevents luggage contents from entangling with the table and other components of the invention.

20 Claims, 11 Drawing Sheets

(56) References Cited

U.S. PATENT DOCUMENTS

2014/0299428 A1* 10/2014 Gadbois ..... A45C 9/00
190/11
2016/0022032 A1* 1/2016 Simon ..... A45C 13/28
108/42
2016/0037905 A1* 2/2016 Glover ..... A47B 3/10
108/42
2016/0045022 A1* 2/2016 Shannon ..... A47B 3/10
108/28
2016/0081469 A1* 3/2016 Undesser ..... A47B 23/06
108/41

* cited by examiner

PORTABLE TRAY FOR LUGGAGE

CROSS-REFERENCE TO RELATED APPLICATION

This non-provisional application claims priority to provisional application No. 62/066,986 filed on Oct. 22, 2014, all of which are owned by the same inventor.

BACKGROUND OF THE INVENTION

The portable tray for luggage generally relates to luggage and more particularly to a tray for luggage that fits within luggage when collapsed. The invention operates as a portable tray and work surface suitable for use as an eating surface and a work surface. The invention often has application as a mobile workspace or desktop surface Currently, devices in the field require special assembly and support polls to secure an eating surface and must be transported in bulky separate cases. Current devices require modifications to the luggage case itself, making design and production changes necessary to typical wheel luggage.

Other inventions in the field provide an eating or beverage surface in a fixed position and require substantial design and production modifications to the wheeled luggage, as well as special assembly and carrying cases. Other inventions in the field require changes to the grip, changes to luggage poles or luggage handle mechanisms, changes to the luggage shell, interior or structure. Other inventions in the field present challenges of their cost or transport. Other inventions require special assembly and additional support poles significantly reducing convenience and portability.

As can be seen, a need exists for a portable tray for luggage.

For millennia, people have had items to accompany them on journeys. People carried small items with them and still do to this day. For larger items and many items for longer journeys, people placed them in a container and put that container on a form of transportation. Early containers took the form of sacks and bags that then became chests and lockers. Chests and lockers had solid construction suitable for rough handling and to defeat the brigands of the ages. Chests and lockers called for various porters to move around and few persons had them. In the last century, people travelled more and more in response to better and less expensive transportation. With more demand for travel came greater demand for better containers for items and clothing for journeys.

Such lighter and better containers became suitcases typically of a hard shell. These suitcases had polymer construction with select steel reinforcement. As the suitcases often went by air, the suitcases sought durability and strength on a low weight. The suitcases though generally had a center handle upon one longitudinal surface and a person lugged it through transportation and the various terminals. The containers became known as luggage.

In recent decades, luggage acquired wheels. Initially, suitcases had two wheels on one longitudinal side opposite the handle and towards a corner. A person would lift one corner of the suitcase and then roll it on wheels. About the same time, luggage also acquired durable lighter weight polymer framing and rugged fabrics. Various shapes and sizes of soft side luggage began to appear in recent decades. With means of travel more available and at lesser cost and with better luggage, business people partook of more in person visits to offices, plants, and customers across the country and beyond.

Travel and work intertwine today more than ever. The mobility mega-trend of "travel meets workspace" means that for millions of professionals, their work place is defined by where they are. The issue of unproductive time when traveling has become now a critical reality. The ability to capture the many millions of under-utilized hours when traveling has become an imperative.

In recent years, the proliferation of lighter and stronger computers merged with travel so that business people brought their computers and nowadays portable electronic devices with them on trips. People may put a computer upon their lap when sitting however, the heat generated by a laptop computer deters that position for long duration. People have sought out various travel desks upon which to place their computers. Some desks have a flat surface attached to a cushion. Other people have put lighter luggage on their laps and then the computer upon that.

With the development of four wheeled upright luggage, people can move their cargo for a short journey readily, typically a business trip. However, people still seek a flat or nearly flat surface close to their upright luggage for computing tasks, reading, lay out of paper, temporary meal location, and the like. People desire a flat surface that also stows readily into their luggage.

DESCRIPTION OF THE PRIOR ART

As will be discussed immediately below, no prior art discloses luggage, which has adjustable, attachable portable food and beverage station that attaches between the luggage handle poles and automatically stores inside a sleeve within the luggage case.

The Dalrymple patent (U.S. Pat. No. 8,485,327) discloses luggage, which has an eating surface that folds out from a top surface of said luggage and of which further includes a cup holder and sides that extend upward from said eating surface. However, the eating surface is integrated into the luggage case requiring substantial design and production modifications to typical wheeled luggage, it is not detachable and extends from the top of said luggage providing a single height for the eating surface, as opposed to a food and beverage station that attaches and detaches from between the luggage handle poles, can be adjusted to various heights as the telescoping luggage handle poles are extended and retracted, and stores inside a sleeve within the luggage case.

The Puchalski patent (U.S. Pat. No. 7,987,955) discloses luggage, with a retractable shelf that extends out from the top of the suitcase and provides support for a portable laptop computer or food or beverage items, However, the design requires specialize vertical telescoping support members and other attachments that must be carried separately, as opposed to a food and beverage station that attaches and detaches from between the luggage handle poles, can be adjusted to various heights as the telescoping luggage handle poles are extended and retracted, and stores inside a sleeve within the luggage case.

The Oliver patent (U.S. Pat. No. 7,510,157) discloses a self-leveling cup holder that is mountable onto the top of an extendable handle of a piece of wheeled luggage. However, the cup holder attaches to the handle of a piece of luggage as opposed to a food and beverage station that attaches and detaches from between the luggage handle poles and stores inside a sleeve within the luggage case.

The Ott patent (U.S. Pat. No. 6,390,431) discloses a device for removably holding a beverage container in an upright position upon a telescoping upright handle of a wheeled luggage unit. Again, the beverage container holder attaches onto the handle of the piece of wheeled luggage as opposed to a food and beverage station that attaches and detaches from between the luggage handle poles and stores inside a sleeve within the luggage case.

The McNeil patent (U.S. Pat. No. 6,604,472) discloses a computer table attachable to a piece of luggage standing in an upright position. However, the computer table does not provide a food and beverage station that attaches and detaches from between the luggage handle poles, can be adjusted to various heights as the telescoping luggage handle poles are extended and retracted, and stores inside a sleeve within the luggage case.

The Riley patent application Publication (U.S. Pub. No. 2006/0219745) discloses a carry-on luggage having a beverage container holder. However, the beverage container holder for the carry-on luggage does not constitute a slide-out beverage holder incorporated in a tray component of a food and beverage station that attaches and detaches from between the luggage handle poles.

The Ryburg patent (U.S. Pat. No. 6,736,073) discloses a work surface for luggage and luggage carriers. However, the work surface requires support legs and a separate case for transporting, does not attach and detach from between the luggage handle poles and does not store in a sleeve inside the luggage case.

The Miller patent (U.S. Pat. No. 6,471,019) discloses a travel case having a deployable and retractable tray table assembly mounted to the back of the housing. Again, the travel case requires special attachments that must be stored and transported separately, does not have an eating surface or beverage holder that attaches and detaches from between the luggage handle poles and does not store in a sleeve inside the luggage case.

The Mullins patent (U.S. Des. Pat. No. 492,486) illustrates an ornamental design for a piece of luggage, which does not depict an eating surface that attaches and detaches from between the luggage handle poles and does not store in a sleeve inside the luggage case.

While the above-described devices fulfill their respective and particular objects and requirements, they do not describe a luggage, which has a portable tray that attaches between the luggage handle poles and stores in a sleeve inside the luggage case. When compared to the prior art that extend behind the luggage case, the present invention operates safely and securely even if the luggage has no load or no cargo. Though the prior art, which extend over the luggage towards the back, will tip unless the luggage has a full load or cargo. In this regard, the luggage with an attachable and portable tray departs from the conventional concepts and designs of the prior art.

The present invention overcomes the disadvantages of the prior art and provides a portable tray for luggage suitable for use in airports, train stations, and the like by many travelers. The present invention also has a portable tray for luggage readily handled by a traveler in a tight time situation.

SUMMARY OF THE INVENTION

Generally, the present invention provides a portable tray for luggage that has a support assembly, a ratchet assembly cooperatively connected to the support assembly, a table connected to the ratchet assembly, and a storage sleeve. The present invention installs within a handle assembly of existing luggage. The support assembly installs upon the telescoping poles of the existing handle assembly. The support assembly then allows a user to position the invention at a desired elevation from a supporting surface such as a concourse floor. The ratchet assembly allows a user to rotate the table from a stowed position, generally parallel and within the poles of a handle assembly, to a cantilevered position inwardly from the poles and across the top of a piece of luggage. The user then unfolds the table of three plates into a flat shape, generally level but with at least two alternate angles. The invention fits into a storage sleeve placed within the handle assembly and within the luggage. The storage sleeve prevents luggage contents from entangling with the table and other components of the invention.

An adjustable attachable and portable food and beverage station, attaches to the telescoping luggage handle poles of a typical 4-wheel luggage case, and stores out of sight inside a sleeve within the luggage case when not in use. The food and beverage station attaches between the luggage handle poles and deploys to securely fix into place using a custom crossbar that fastens to the luggage handle poles. The food and beverage station provides a convenient tray surface for food and includes a slide-out beverage holder.

The luggage with an adjustable, attachable and portable tray includes a typical four-wheeled luggage case having a tray with an alternate slide-out beverage holder that attaches between the luggage handle poles and adjusts to various heights by the telescoping luggage handle poles to which it attaches that themselves extend and retract.

The present invention provides a foldable tray surface that cantilevers over the sidewall and inwardly from the back to the front of the luggage. The foldable tray surface, by not resting on top of the luggage case and by extending in front of the luggage case, and not toward the back, dramatically reduces the risk of tipping the luggage.

There has thus been outlined, rather broadly, the more important features of the invention in order that the detailed description thereof that follows may be better understood and that the present contribution to the art may be better appreciated. The present invention also includes grips that fix the elevation of supports in the support assembly, a button and cooperating spring in the ratchet assembly, two claws biased by two springs in the ratchet assembly, three plates that fold in a predetermined sequence, double hinges between pairs of the three plates, and alternate embodiments with a plate that engages the poles of a handle assembly using a clip. The present invention also includes installation in existing luggage, an adjustable position along the luggage handles selected at a height above floor by a user, three angled positions of the table for select uses, the invention when folded fits within two percent of the space, the invention has a volume less than sixty cubic inches, and the invention has its hinges fitting within the edge planes of the table when folded. In use, the table in cooperation with the ratchet has at least three angle positions, or orientations relative to a supporting surface. The orientations include an angle above level that accommodate the play and lean inherent in luggage handle assemblies, level, that is, parallel to a supporting surface, and an angle below level that accommodates use of a keyboard equipped device. In a further alternate embodiment, the invention includes counterweights applied to the bottom of the sleeve. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a portable tray for luggage that stores within luggage, extends with the luggage handles, cantilevers over the luggage, and unfolds into a nearly flat orientation, then folds and stores compactly back in the luggage.

Another object is to provide such a portable tray for luggage that adds

Another object is to provide such a portable tray for luggage that has an adjustable attachable and portable food and beverage station.

Another object is to provide such a portable tray for luggage that has a crossbar or handle, and a tray unit which is attachable and detachable from between the luggage handle poles.

Another object is to provide such a portable tray for luggage that extends to a raised and secured position above the top of luggage when the luggage handle has an extended and a lowered position between the luggage handle telescoping poles.

Another object is to provide such a portable tray for luggage that has a crossbar attaching to the luggage handle poles with a spring plunger or retractable pegs that insert into milled holes and housing in the luggage handle poles.

Another object is to provide such a portable tray for luggage that has its crossbar attaching to the luggage handle poles with pole clamps.

Another object is to provide such a portable tray for luggage that has its tray or table mounted to the crossbar with pivoting hanging brackets.

Another object is to provide such a portable tray for luggage that has its tray raised to various heights by virtue of the telescoping luggage handle poles to which it is attached that can be extended and retracted.

Another object is to provide such a portable tray for luggage that when not deployed in a raised position, the invention remains in place in a lowered position by a retractable peg system installed inside the crossbar, the peg is extended in front of the hanging bracket keeping the hanging bracket in a vertical position.

Another object is to provide such a portable tray for luggage that when deployed in a raised position, the invention has secure support from a retractable peg system installed inside the crossbar component, in the raised position, the hanging brackets sit on top of the extended pegs providing stability to the tray.

Another object is to provide such a portable tray for luggage that when to deploy or store the food and beverage station, the pegs are automatically retracted allowing the invention to move between a raised position and the lowered position.

Another object is to provide such a portable tray for luggage that has a storage sleeve installed inside the luggage case between the luggage handle poles to house the invention.

Another object is to provide such a portable tray for luggage that the storage sleeve has a rigid construction such that when the invention is removed, the sleeve maintains its shape, and deters the luggage contents from compressing the sleeve and increasing the difficulty to receive the invention when it is returned to the sleeve.

Another object is to provide such a portable tray for luggage that as the telescoping luggage handle poles collapsed into the luggage, the invention rides along with the telescoping luggage handle poles as they retract and the invention self-holsters inside the storage sleeve.

Another object is to provide such a portable tray for luggage that at the top of the storage sleeve which houses the invention when being stored has a spring loaded door flap that automatically closes when the crossbar and tray withdraws far enough into the storage sleeve and when once the crossbar and tray exits from the storage sleeve as it is lifted from luggage as the telescoping handle poles are extended.

Another object is to provide such a portable tray for luggage that has an expandable tray via a bi-fold or tri-fold design with piano-hinging and alternatively includes underneath slide-out extensions that create a larger surface while maintaining stability.

Another object is to provide such a portable tray for luggage that incorporates a slide-out beverage holder.

Another object is to provide such a portable tray for luggage that may be made of polymer, plastic, metals, wood, carbon fiber composite, or other suitable material.

Another object is to provide such a portable tray for luggage that may attach easily and detach as well between the luggage handle poles, requires no additional carrying case, and requires no special assembly or supporting mechanisms.

Another object is to provide such a portable tray for luggage that can be raised to various heights upon the telescoping luggage handle poles to which it attaches.

Another object is to provide such a portable tray for luggage that easily stores inside the luggage in a protective sleeve, remaining attached to the telescoping luggage handle poles for easy deployment.

Another object is to provide such a portable tray for luggage that operates independently from the luggage poles such that a user may raise or lower the luggage poles with or without the invention being deployed.

Another object is to provide such a portable tray for luggage that has a unique conical shape and material texture of the support stops of the stop assembly of the invention allows for its use with many different types and shapes of luggage poles.

Another object is to provide such a portable tray for luggage that does not require changes to the existing handgrip, nor changes to luggage poles, nor changes to luggage handle mechanisms, nor changes to the luggage shell, interior or structure, and allows the purchasing traveler to easy upgrade their existing roller luggage with the invention.

Another object is to provide such a portable tray for luggage that has its tray with an internal structure of an interlocked cell structure and hexagonal pattern, or honeycomb like, design for stiffening that has a high strength to weight ratio providing rigidity and stability with ultra-lightweight.

Another object is to provide such a portable tray for luggage that has a low cost of manufacturing so the purchasing travelers, tour operators, tourists, businesses, and organizations can readily buy the portable tray for luggage through stores and supply sources.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated and described a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
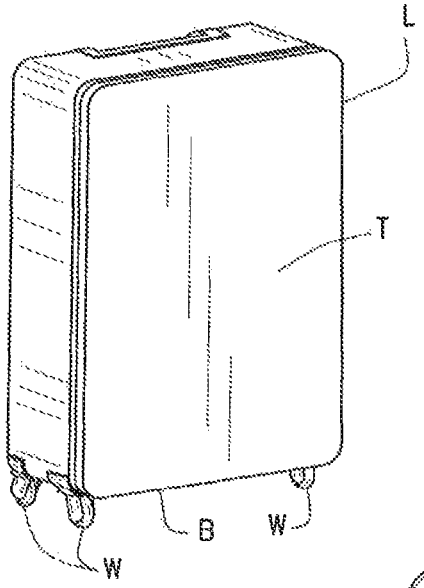
FIG. 1 PRIOR ART
FIG. 1 shows a perspective view of prior art luggage.

The present invention overcomes the prior art limitations by providing a portable tray for luggage generally used by a traveler who desires a flat or nearly flat platform for food and beverage or an electronic device, respectively.

The following detailed description is of the best currently contemplated modes of carrying out exemplary embodiments of the invention. This description is not to be taken in a limiting sense, but is made merely for the purpose of illustrating the general principles of the invention, since the scope of the invention is best defined by the appended claims.

Broadly, an embodiment of the present invention provides a portable tray for luggage comprising: a support mechanism such as a cross bar and the like, removably attached to a first side and a second side of a luggage handle; and a multi fold tray attached to the support mechanism, wherein the multi fold tray comprises and open position and a closed position, wherein the open position further comprises an unfolded configuration of the multi fold tray extending out and above the luggage, and the closed position comprises a folded configuration.

As illustrated in the appended figures, a portable tray for luggage device may include a support mechanism. The portably tray for luggage device may removably attach to a piece of luggage. The luggage may include a telescoping handle. The support mechanism may removably attach to the luggage handle. A multi fold tray may attach to the support mechanism. The multi fold tray has an open position and a closed position. When in the closed position, the multi fold tray has its folds so that it may fit within the span of a luggage handle. The multi fold tray may lie against the luggage when the handle attains a completely down position. In certain embodiments, a storage sleeve may be included on the piece of luggage, so that the multi fold tray may remain inside the storage sleeve when not in use. When in the open position, the multi fold tray unfolds and expands to a length that may exceed that of the width of the luggage. The multi fold tray has a relatively horizontal position in relation to the upright luggage piece and approximately perpendicular to the luggage handle. Horizontal generally means a plane defined by a flat surface supporting the luggage, such as a floor, a hallway, a gallery, and the like. In certain embodiments, the multi fold tray also includes a beverage holder that extends slidingly from within the multi fold tray.

In other certain embodiments, the multi fold tray attaches to the support mechanism by pivoting brackets. The support mechanism attaches to the luggage handle by spring plungers, retractable pegs, and the like. The multi fold tray secures into its open position by retractable pegs inside the cross bar and the like. The multi fold tray also provides a larger useable surface for eating, drinking, working, and the like while the user transits from destinations with the luggage at hand. The device alternatively attaches to the luggage during manufacturing or as an after market product. Attachment also may utilize holes drilled or other wise made into the luggage handle. The support mechanism attaches by spring plungers, retractable pegs, pole clamps, and the like. The multi fold tray has select positions where it lies flat against the luggage, lies within a storage sleeve, and the like. The addition of the device to a piece of luggage may call for a limited amount of changes when retrofitting and allows for ease of manufacturing. The elevation about a horizontal surface of the multi fold tray may vary depending on the position of the telescoping luggage handle.

Turning to FIG. 1, the present invention applies to the field of luggage. FIG. 1 shows a piece of prior art wheeled luggage L, generally rectangular, with a lid T shown in the right foreground. The luggage has an upright orientation, that is, with its length generally perpendicular to a support surface, not shown. This luggage L has a plurality of wheels W upon its bottom surface B as shown. The lid has a position generally outwardly from the wheels. The wheels permit a user to move around the luggage without lifting it and without tipping it. The wheels generally orient the luggage with its smaller footprint side towards a supporting surface and its longer lid upwardly from the supporting surface.

Figure 2:
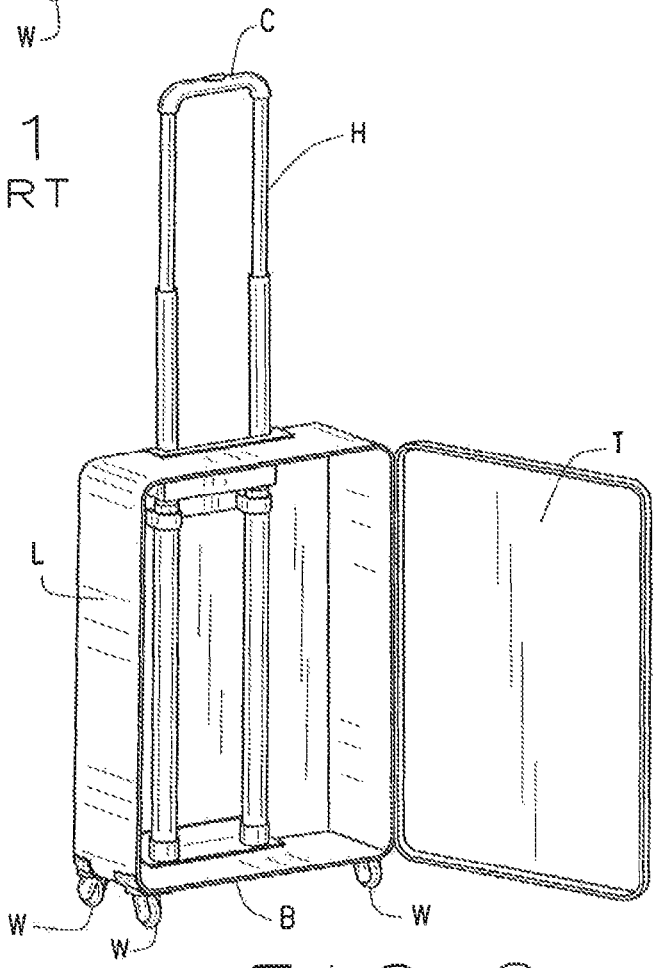
FIG. 2 PRIOR ART
FIG. 2 provides a perspective view of prior art luggage showing its interior.

A user opens the luggage L typically by unzipping the lid T and then pivoting the lid outwardly from the prior art luggage as shown in FIG. 2. The lid generally has a rectangular shape with some rigidity so that it retains its shape when unzipped or otherwise separated from the luggage as shown. The luggage has its wheels W upon its bottom B as before. Opposite the lid T, within the luggage L, and inwardly from the bottom B, a handle assembly H spans from the bottom upwardly for the length of the luggage as shown. The handle assembly generally has two spaced apart, telescoping poles that extends upwardly and outwardly from the luggage as shown. The poles have a cross member C as shown that spans their ends opposite the luggage. The poles generally telescope with at least two sections. The poles have various cross sections including round, oval, square, rectangular and the like.

Figure 3:
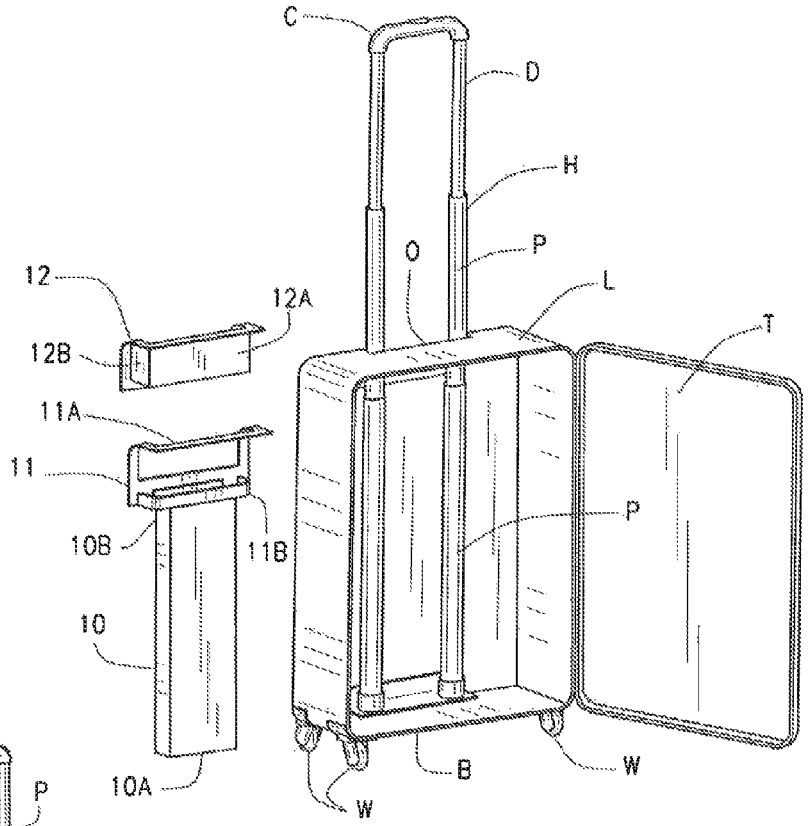
FIG. 3 illustrates a partially exploded view of a portion of the preferred embodiment of the invention proximate prior art luggage.

FIG. 3 shows a piece of luggage L with its lid T open as in FIG. 2. For further description, the luggage has its bottom B with the wheels W. Opposite the bottom, the luggage has its top D generally formed into the sidewall of the luggage. The top is a surface opposite the wheels as shown. The luggage has an opening O through the top that allows passage of the handle assembly H. Here, this handle assembly has two spaced apart poles P that each have two sections P extending outwardly from the bottom B. The two poles, at their outermost section, have a handle C that spans the two sections. The handle allows a user to release the poles from storage within the lowest section inside the luggage and to extend the poles outwardly and fully as shown in FIG. 3. The present invention provides into the opening O a sleeve 10 merged to a cooperating head 11. The sleeve has a generally hollow, prismatic form that fits snugly within the poles P of the luggage. The sleeve has a generally rectangular cross section and durable construction that resists compressive loads from baggage handling and engagements from clothes and shoes stored near the poles. The sleeve has two opposite ends, a first end 10*a*, and an opposite open second end 10*b*. The first end is generally closed and has a location proximate the bottom B when installed. The second end remains open to receive additional parts of the invention described infra. The second end joins to the cooperating head 11 as shown. The head has a generally planar form with an inverted L like shape that follows the contour of the luggage where the top T joins to the back of the luggage. The head has an aperture 11*a* through most of its length and slightly less in dimension than the opening O. Opposite the flange like portion of the head, the head has a band 11*b* outwardly from the sleeve. The band generally fits outwardly upon the poles P inside the luggage as later shown in FIG. 4. The aperture 11*a* receives an outer cap cover 12 of a cooperating shape that has an inwardly extending shelf 12*a*. The outer cap cover has a flange 12*b* outwardly of the shelf that fits upon the head 11 when assembled. The shelf 12*a* extends inwardly from the flange 12*b* and generally has a reversed L shaped cross section with the web after the flange of the L shape. The shelf 12*a* has its own rectangular opening, not shown, that admits the sections of poles when extended and the remainder of the invention as later shown and described. The outer cap cover follows the contour of the luggage, particularly where the top T joins the back. The outer cap cover provides a smooth fit of the invention into the handle assembly and prevents items from entering into the invention.

Figure 4:
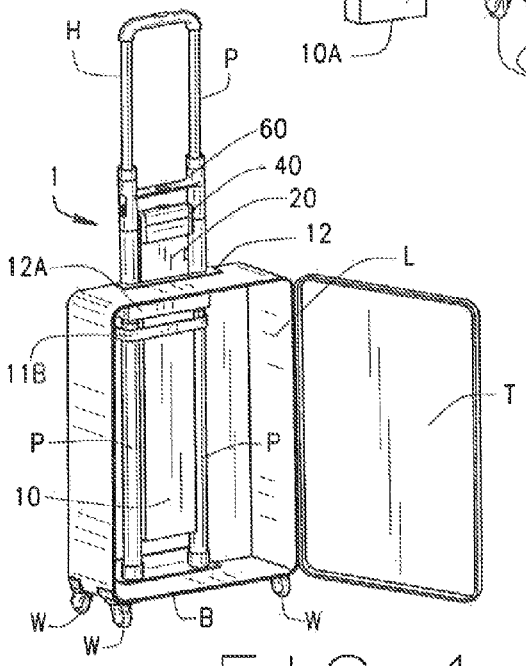
FIG. 4 describes a perspective view of the present invention installed within luggage and partially extended from the luggage.

Then FIG. 4 shows the invention 1 placed within the sleeve 10 and the sleeve placed between the poles P of the handle assembly H of luggage L. The luggage L has its lid T open to show the invention. As discussed with FIG. 3, the head 11 has its band 11*b* that fits around the poles P. The band has its width that provides a snug fit and permits connection of the band to the poles if desired. Above the band and the first section of poles, the shelf 12*a* appears beneath the top T and inwardly towards where the lid appears when closed. Outside from the shelf and adjoining the top T, the outer cap cover 12 has its place secured against the top and joined to the head. From within the sleeve 10, through the head 11 and the outer cap cover 12 comes the remainder of the invention with its table 20, here shown folded, a ratchet assembly 40 connected to the table, and a support assembly 60 connecting to the ratchet assembly. The handle fits upon the poles and allows select sections of the poles to pass through it. The handle also temporarily fastens to select sections of poles at an elevation above a supporting surface as desired by a user. The table 20, ratchet assembly 40, and a portion of the support assembly 60 store within the outer cap cover 12 and the sleeve 10 when a user has stored the invention and collapsed the poles P into their compact form, such as when the luggage remains in the care of an airline.

Figure 5:
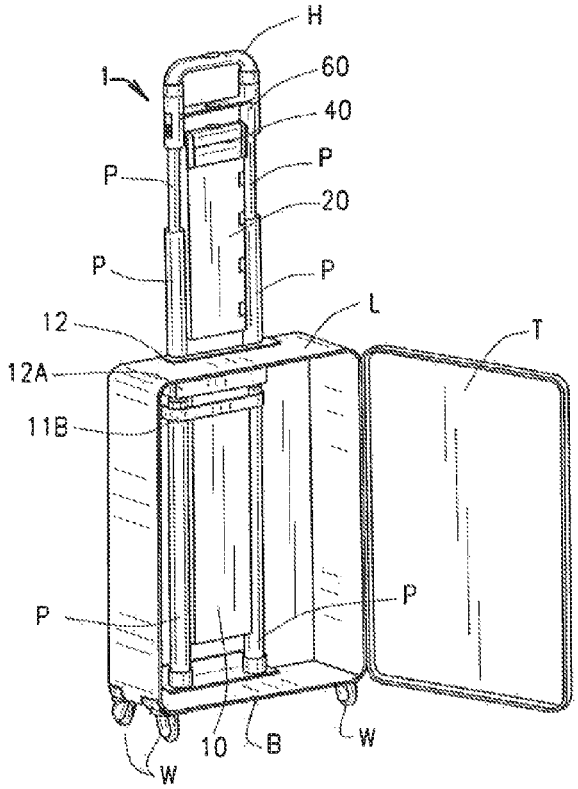
FIG. 5 provides a perspective view of the present invention fully extended from the luggage.

FIG. 5 then shows the invention fully extracted from the luggage L, here shown with its lid T open. The interior of the luggage has the poles P connected to the bottom B of the luggage proximate the wheels W. The sleeve 10 occupies most of the space between the lowest of the pole sections as shown. The sleeve fits within the pole sections and above the bottom B. To elevate the sleeve above the bottom, the band 11*b* affixes to the head 11 and connects to the cap cover 12 from beneath via mechanical fasteners, such as screws, rivets, and the like. A user pulls the handle assembly H outwardly from the luggage L so that the table 20 clears the cap cover 12. Typically, the user extends at least one section of poles P above the poles within the luggage. Proximate the handle assembly H, the invention has its support assembly 60 with its crossbar 61 spanning between the two poles P and beneath the handle assembly H as shown. The support assembly holds the ratchet assembly 40 generally spaced beneath the crossbar 61. The ratchet assembly joins to the table 20 as later shown. The table as shown in this figure attains a rest position, generally within the poles both left to right and front to back.

Figure 6:
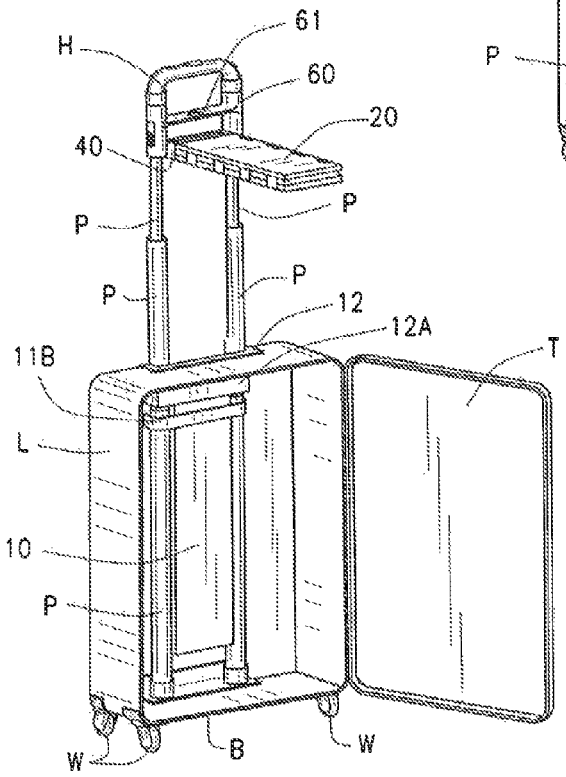
FIG. 6 provides a perspective view of the present invention fully rotated outwardly from the luggage.

FIG. 6 then shows the table 20 rotated into position for use. Here, the table extends generally perpendicular to the poles P and inwardly towards the lid T. The table rotates upon the ratchet assembly 40 so that the table cantilevers inwardly from the poles. As shown, the table includes multiple plates, as later shown, that nest into a compact form with common left and right edges so that the folded table fits within the poles for storage. Here, the table as shown in this figure attains an out position, generally cantilevered.

Figure 7:
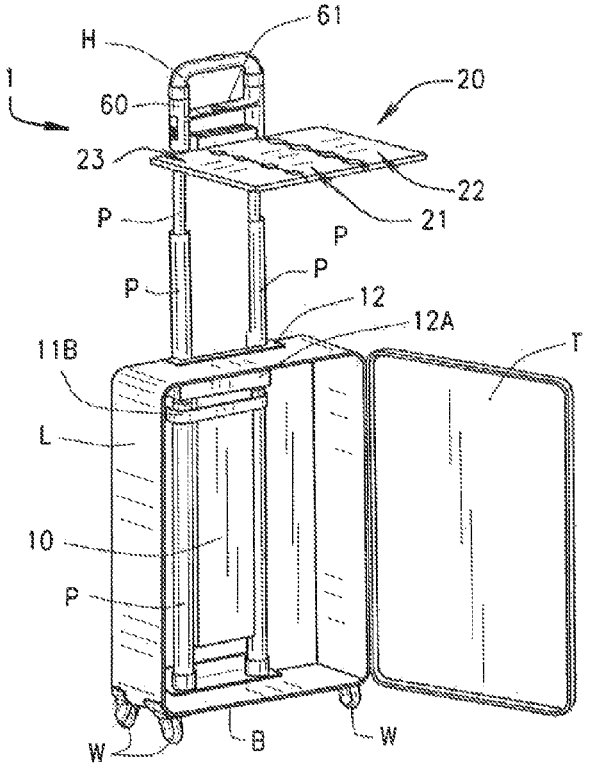
FIG. 7 provides a perspective view of the present invention fully open.

The table 20 appears open in FIG. 7 so that a user may place an item upon it. The table has a center plate 21, an outer plate 22, and an inner plate 23 hingedly connected as later described. The center plate connects to the ratchet assembly 40 while the outer plate and the inner plate mutually unfold outwardly from the center plate. In this figure, the table 20 has a perpendicular orientation to the poles P. However, the Applicant foresees the table having alternate angular orientations to the poles for other uses. For example, the table has a two degree downward tilt that accommodates play in the existing handle assemblies. For example, the table has a greater downward tilt but less than ten degrees to accommodate a laptop or other electronic device. Here, the table as shown in this figure attains an unfolded position, ready for use.

Figure 8:
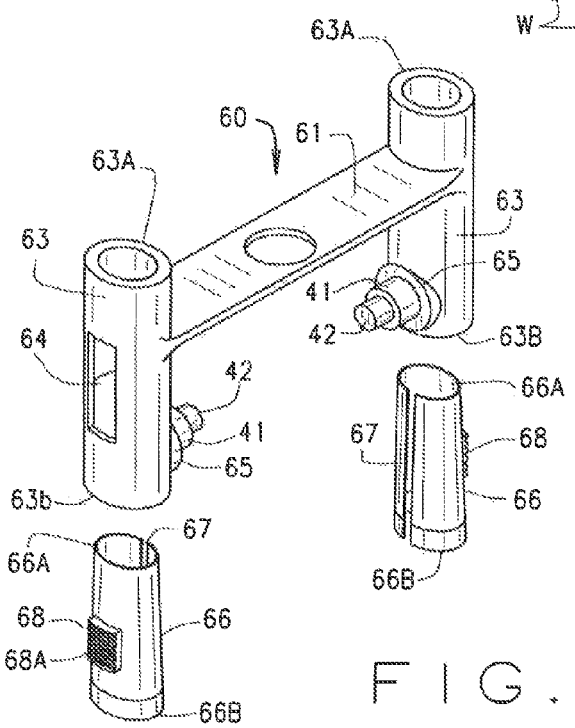
FIG. 8 illustrates an exploded view of the support of the present invention.

As described above, the table rotates upon the ratchet assembly 40 operatively connected to the support assembly 60. FIG. 8 provides the support assembly 60 in greater detail. The support assembly has a generally H like shape with its crossbar 61 having an aperture 62 generally in the center. The crossbar extends outwardly to merge with the two supports 63. Each support has a generally hollow cylindrical shape with two opposite open ends: an upper end 63*a* and a lower end 63*b*. The crossbar has its position generally closer towards the upper ends of the supports. The supports have a cross section shaped to fit a set of existing poles. Here, the supports have a generally oval cross section though the Applicant foresees the supports having other shapes for their cross sections depending on pole shape. Opposite the crossbar, each support has a slot 64 extending downwardly and partially along the length of the support. The slot has a generally rectangular shape. Beneath the slot and opposite the crossbar, each support has a base 65 somewhat cylindrical mutually extending inwardly. Upon the base, each support has a ratchet 41 having at least one tooth, as later shown, and a diameter slightly less than that of the base. Outwardly, each ratchet has a pin 42, generally cylindrical and of lesser diameter than the ratchet. The pin engages a cooperating aperture in the center plate of the table as later described. The pins 42 of each support align mutually inwardly.

The support assembly 60 also includes two stops 66 having a hollow, interrupted, truncated conical shape. The stops have a narrow upper end 66*a* and an opposite lower end 66*b*. A slit 67 extends from the lower end 66*b* to the upper end 66*a*. The slit has a width no more than five times the thickness of the stop's material. Generally the stop has a construction from a thin material formed into its truncated conical shape with the upper end being of narrower dimension than the lower end. In use, the slits 67 of both stops 66 have a mutual orientation inwardly, that is, towards the pins 42 of the support assembly. Opposite the slits, each support has a grip 68 of generally rectangular form and extending outwardly from the support at least twice the thickness of the stop's material. The grip has an outer surface 68*a* with a roughened surface, here shown as parallel grooves though other knurling is foreseen. The grip allows a user's finger or thumb to move a stop 66 within a support 63 to lock the position of the support assembly 60 upon one pole.

Figure 9A:
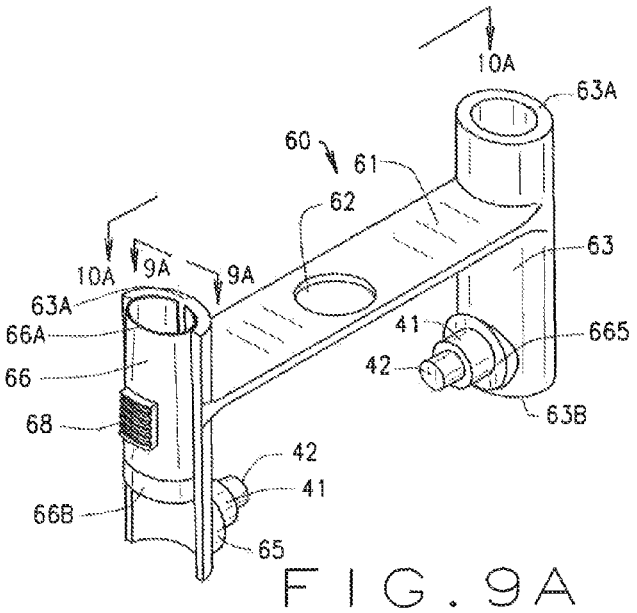
FIG. 9A illustrates a perspective view of the support of the present invention.

FIG. 9*a* shows more of the cooperative operation of a stop 66 within a support 63. This figure shows the support assembly 60 of FIG. 8 but with the support 63 on the left shown in a partial section. The support assembly 60 moves along the existing handle assembly H, particularly the poles P, shown in FIGS. 4-7. The movement occurs when the poles move smoothly through the stops 66 installed within the supports 63. A user though has a desired elevation of the table 20 and thus must secure the support assembly upon the poles. For that securement, the user presses a thumb upon the grip 68 of a stop 66 and urges the stop upwardly, that is, the upper end 66*a* of the stop towards the upper end 63*a* of the support. This moves the stop from a low position, later shown in FIG. 9*b*, to a high position, shown here. Typically, the grip 68 moves to the upper most limit of the slot 64 under the action of the user's thumb. In this high position, the slit closes at the upper end 63 as shown. By closing the slit, the stop compresses upon a pole, increasing friction immensely and preventing further axial movement of the support on that side of the support assembly. The support assembly has a symmetric construction so that the support not shown in section in this figure still has the same construction as that support shown in section.

Figure 9B:
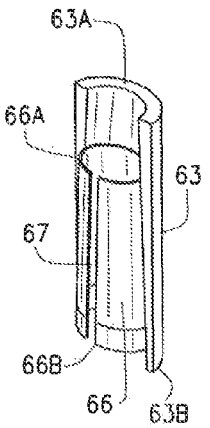
FIG. 9B illustrates a detailed view of a support stop within a support of the present invention.

FIG. 9*b* then shows a stop 66 in its low position, that is, towards the lower end 63*b* of the stop. In this position, the stop has its slit 67 generally open and the lower end 66*b* of the stop towards the lower end 63*b* of the support as shown. With the slit open, the stop relaxes its grasp upon a pole, not shown, and allows the support 63 to move axially upon the pole. The slit shown as open and the stop away from the upper end 63*a* indicates that the grip 68 abuts the lower portion of the slot 64, not shown. This figure initially shows that the support towards its upper end 63*a* has a conical interior.

Figure 10A:
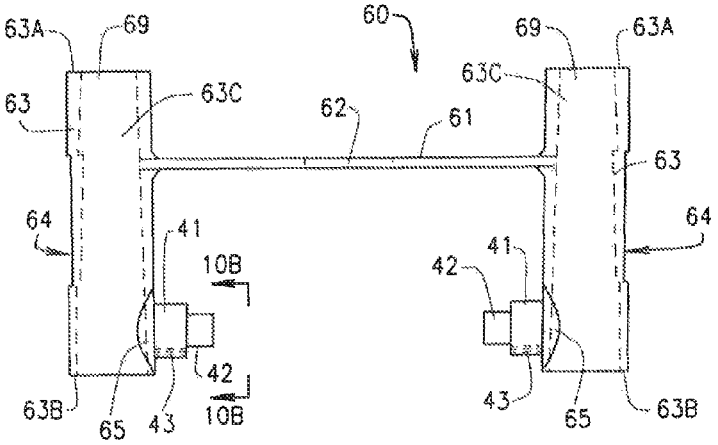
FIG. 10A shows a section view through the support of the present invention.

The interior of the supports 63 appears in FIG. 10*a* showing a sectional view through the support assembly within stops omitted. The support assembly 60 has its crossbar 61 with aperture 62 as before. The crossbar has a generally thin cross section as shown. The crossbar extends outwardly and merges into the walls of the two supports 63 here shown in section view. Each support has its hollow, cylindrical form with its upper end 63*a* and opposite lower end 63*b*. The lower end has the base 65 with ratchet 41 and pin 42 extending mutually inwardly. From the upper end 63*a* to the lower end 63*b* of each support, an interior chamber 69 extends. The interior chamber has a generally slight conical form that narrows from the lower end 63*b* to the upper end 63*a*. The narrowing urges the stop 66 to constrict when the grip 68 advances upwardly and then the stop closes the slit and grasps the pole P. The narrowing occurs over at least 0.5 degrees along the length of the chamber.

Figure 10B:
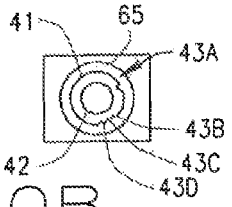
FIG. 10B shows a detailed side view of the ratchet of the present invention.

Beneath the slot 64 on each support and above the lower end 63*b*, the support has the ratchet 41 showing a plurality of teeth 43. The teeth have an orientation here shown downwardly. The ratchet 41 and the teeth 43 take form in a partial end view of FIG. 10*b*. Each support has its base 65 to which joins the ratchet 41 with the pin 42 centered upon it. The ratchet has, going clockwise, a first tooth 43*a*, a second tooth 43*b*, a third tooth 43*c*, and a fourth tooth 43*d*. The Applicant foresees additional teeth for additional angular orientations. The first tooth has a position 88 degrees clockwise from a centered vertical line generally parallel to the length of the drawing sheet. The second tooth, the third tooth, and the fourth tooth correspond to selected angular orientations of the table 20, as shown in FIG. 7. The fourth tooth is 92 degrees further clockwise from the first tooth. The 92 degree orientation allows for the table to accommodate play or slippage in existing handle assemblies when extended outwardly from luggage.

Figure 11:
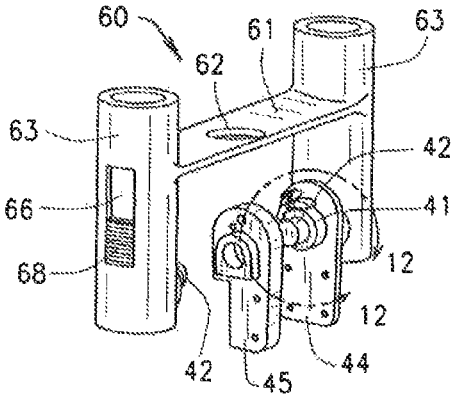
FIG. 11 describes a perspective view of the support with a partial view of the claw of the present invention.

Having mentioned table and angular orientations, FIG. 11 shows the beginning of the table's 20 connection to the ratchet. The support assembly 60 has its supports 63 in an H like shape upon the crossbar 61. Each support has the slot 64 with a stop and a grip 68 shown and the pin below the slot but upon the interior of a support. For clarity, this figure shows upon the support 63 to the right, a partially exploded view of the table connection upon the pin 42 and engaging the ratchet 41. A cover 44 fits over the pin and around the ratchet and a casing 45 fits over the cover. The cover has a generally elongated rectangular form with one end rounded as shown and an aperture that admits the ratchet. The casing also has a generally elongated rectangular form that cooperates with the cover and fits snugly upon it.

Figure 12:
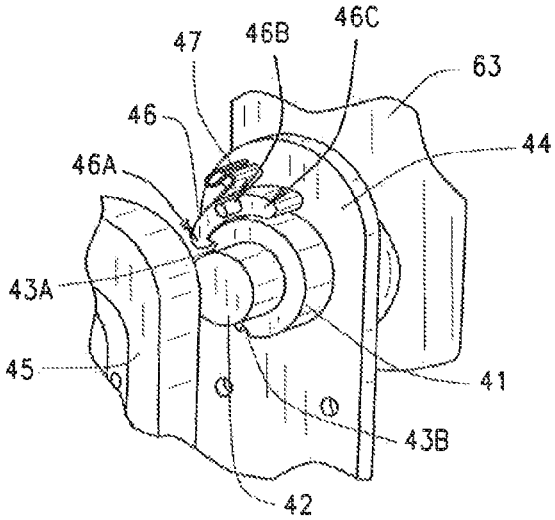
FIG. 12 describes a detailed view of the claw engaging the ratchet of the present invention.

FIG. 12 provides a detail view of the ratchet assembly 40 ready for use. Upon each support 63, the ratchet 41 extends from the base 65 as before with a pin 42 in the center. The cover has its aperture 44 that admits the ratchet and proximate the rounded end as shown, it has a mechanism. The mechanism includes a claw 46 pivotally mounted to the cover and a claw spring 47 secured to the cover but having a free end biasing the claw to rotate inwardly, here shown as counterclockwise. The claw has an arcuate form with its own tooth 46*a* upon one end, then a pivot point 46*b*, and an opposite end 46*c*. The claw has a length sized for its proper balance and suitable mechanical engagement of select teeth 43. In this figure, the claw tooth 46*a* engages the first tooth 43*a* so that the table remains in its stowed orientation, that is, within the poles as in FIGS. 4, 5. This figure also shows a representation of another tooth 43 beneath the pin, such as the fourth tooth 43*d*. The casing 45 has its shape to enclosing the ratcheting mechanism just described.

Figure 13:
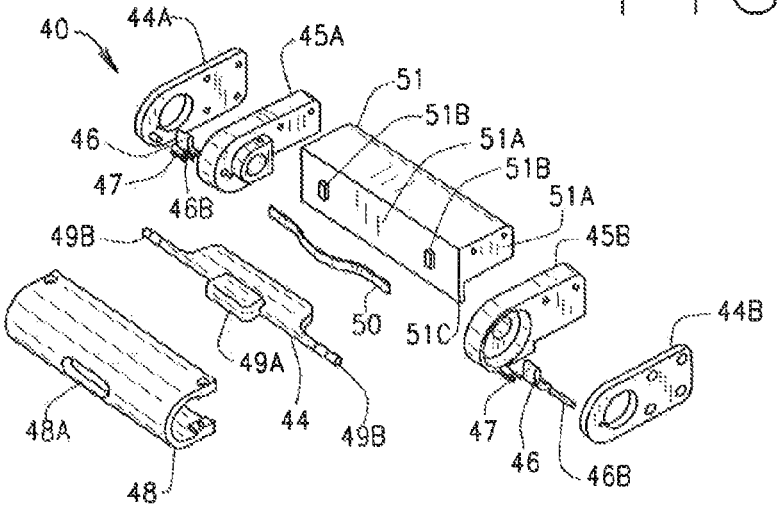
FIG. 13 provides an exploded view of the ratchet assembly of the present invention.

The ratchet assembly operates with user input through a button and related components shown in FIG. 13. A user sees a back cover 48, here shown as an elongated U shaped cross section, with a centered aperture 48*a*. The back cover has a length similar to that of the crossbar 61. Within the back cover, a release button 49 extends outwardly. The release button has a generally thin rectangular form of a length less than the back cover. The release button has a knob 49*a* upon one edge that enters the aperture 48*a* for a user to touch. Outwardly from the knob upon the same edge, the release button has two tips 49*b* of generally thinner round cylindrical shape. The release button then abuts a ratchet spring 50 on the release button's edge opposite that of the knob. The ratchet spring has a generally strip like form with a convex curve centered within it. The ratchet spring then rests upon a center plate 51 here shown as a rectangular member with a flange 51*a* upon one face extending downwardly as shown. The flange has its depth greater than the remainder of the center plate, with a lip 51*c* below the center plate. The flange has two slots 51*b* that receive the ends of the ratchet spring. The center plate has two opposite ends and each end receives a casing 45, with a left casing 45*a* towards the left of this figure and a right casing 45*b* toward the right of this figure. The left casing appeared previously in FIGS. 11, 12. The left casing and the right casing have a generally mirror image shape to them. As above, each casing has a generally elongated rectangular shape with one end rounded. Each casing has its depth and a chamber formed with the rounded end that receives the claw 46, the pivoting pin as at 46*a*, and the claw spring 47. Each casing then becomes enclosed by a cover 44 with a left cover 44*a* and a right cover 44*b* shown respectively. The covers have a generally rectangular plate like shape with one end rounded to cooperate with the casing and to ease rotation of the table 20. In operation, the user presses the knob 49*a* that moves the release button towards the center plate which urges the tips 49*b* to press upon the free ends 46*c* of the claws to disengage them for rotation of the table.

Figure 14:
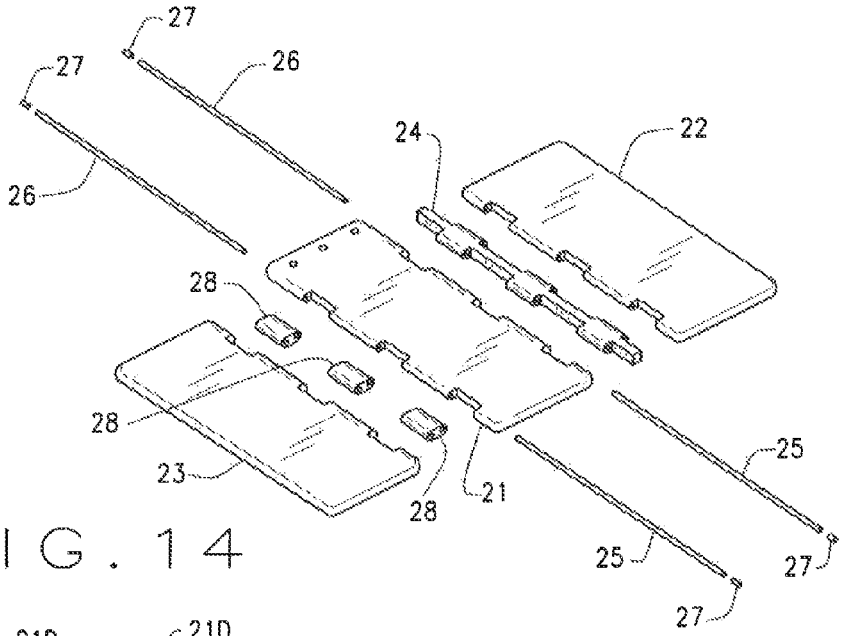
FIG. 14 illustrates an exploded view of the table of the present invention.

The table has had various mentions so far and now FIG. 14 shows the components of the table in an exploded view. The table 20 has a center plate 21, an outer plate 22 here shown to the right, and an inner plate 23 here shown to the left. The outer plate has that name because upon folding the table, see FIG. 6, the outer plate appears on the outside of the table. The inner plate also has its name for its location between the outer plate and the inner plate upon the folding of the table, see FIG. 6. The center plate has a generally thin rectangular form with two shorter lateral sides and two longitudinal sides. Each longitudinal side has three notches. One lateral side has three apertures nearby for connection to the other center plate 51 of the ratchet assembly. The center plate has a hinged connection to the outer plate using a long spine 24 upon an inner axle 25 and upon an outer axle 26. The long spine is an elongated square shaft with three wider rectangular sections that cooperate with the notches on the center plate and the notches upon the outer plate. The three wider sections include lengthwise holes that admit the inner axle and the outer axle respectively. The inner axle and the outer axle are generally rod like in shape though of slightly different length. Each axle has two plugs 27, one on each end for enclosing the axle within the appropriate plates.

The outer plate has a generally thin rectangular form with two shorter lateral sides and two longitudinal sides. The lateral sides have a slightly lesser length than those of the center plate to allow for operation of the hinge. One longitudinal side has three notches of similar shape as the notches on the center plate. The side outwardly from the notches includes coaxial holes to admit the outer axle 26 there through. The outer plate has a hinged connection to the center plate using the long spine 24 but upon the wider sections commonly connects upon the outer axle 26.

The inner plate then has its generally thin rectangular form with two shorter lateral sides and two longitudinal sides. The lateral sides have a lesser length than the lateral sides of the center plate and of the outer plate. One longitudinal side has three notches of similar shape as the notches on the center plate. The side outwardly from the notches includes coaxial holes to admit the outer axle 26 there through. The inner plate has a hinged connection to the center plate using three short spines 28. Each short spine has a generally rectangular form with a thickness similar to the center plate and the inner plate. Each short spine has two spaced apart mutually parallel holes. The short spines commonly connect upon the inner axle 25 for pivotal engagement with the center plate and upon the outer axle 26 for pivotal engagement with the inner plate. The short spines and the long spine operate as double hinges so that the inner plate folds upon the center plate and the outer plate folds upon the inner plate in a compact form of the table for stowage, see FIG. 6, without any hinge pins, here axles, extending outwardly.

Figure 15A:
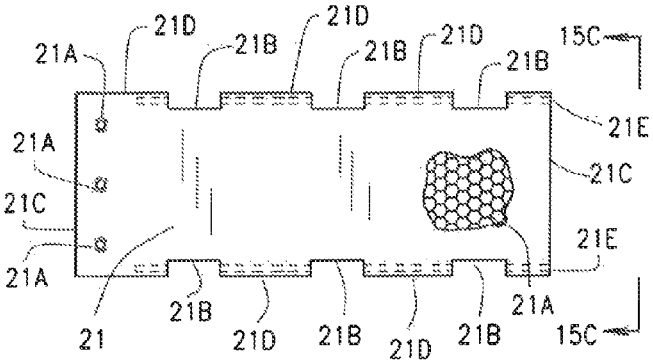
FIG. 15A shows a top view of the center plate of the present invention.

Looking at components of the table 20, FIG. 15A provides a top view of the center plate 21. The center plate has a generally rectangular form with two mutually parallel, spaced apart, shorter lateral edges 21*c* and two mutually parallel, spaced apart, longitudinal edges 21*d*. The longitudinal edges are perpendicular to the lateral edges. Further, the longitudinal edges each have three notches 21*b* equally spaced about the center of the three notches. Each longitudinal edge, slightly inwardly, has an inside hole 21*e* bored substantially through it. The inside hole receives an inner axle through one lateral edge and along the longitudinal edge but not through the second lateral edge. The center plate has a greater length of longitudinal edges proximate the apertures than at the opposite lateral edge away from the apertures. Within the lateral edges and the longitudinal edges, the center plate has internal stiffening through a hexagonal pattern, 21*a*, or honeycomb like. The internal stiffening has a high strength to weight ratio so that the table 20 made of its component parts, such as the center plate, supports a load with the least weight of materials necessary thus avoiding the luggage becoming to heavy for a user or subject to overweight baggage charges. The internal stiffening has a regular pattern encased within an outer wrapping, coating, sleeve, and the like that presents a smooth surface for use.

Figure 15B:
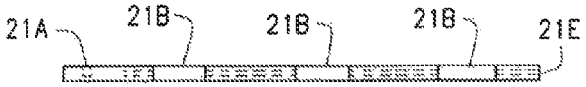
FIG. 15B shows a side view of the center plate.

Turning the center plate onto a longitudinal edge, FIG. 15*b* shows a side view of the center plate with the notches 21*b* in the foreground. This view has the apertures 21*a* to the left and the other lateral edge 21*c* to the right. The inside bore 21*e* extends along the longitudinal edge from the right to the left. However, the inside bore does not extend towards the aperture. The inside bore does not open at the lateral edge on the left. Effectively, the inner axle inserts into the inside bore from the right only in this figure.

Figure 15C:
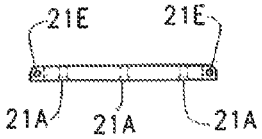
FIG. 15C shows a rear view of the center plate.

And FIG. 15C shows an end view of the center plate with the lateral edge 21*c* towards the foreground and the apertures 21*a* shown in the background. Outwardly from the apertures, the center plate has its two inside bores 21*e* here shown on end. The presence of the two inside bores indicates this view shows the lateral edge 21*c* opposite that lateral edge closer to the apertures.

Figure 16A:
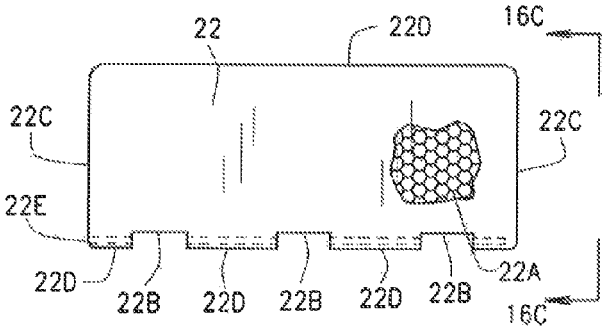
FIG. 16A provides a top view of the outer plate of the present invention.

FIG. 16A then provides a top view of the outer plate 22, so named as it has an outer position of the three plates when folded. The outer plate also has a generally rectangular form with two mutually parallel, spaced apart, shorter lateral edges 22*c* and two mutually parallel, spaced apart, longitudinal edges 22*d*. The longitudinal edges are perpendicular to the lateral edges. Only one longitudinal edge has three notches 21*b* equally spaced about the center of the three notches. This longitudinal edge, slightly inwardly, has an outside hole 22*e* bored substantially through it. The inside hole receives an outer axle through one lateral edge and along the longitudinal edge but not through the second lateral edge. The opposite longitudinal edge has a smooth appearance and no notches and no holes. The outer plate has a greater length of longitudinal edges towards the right of the figure, where the outer hole ends short of the lateral edge as shown. Within the lateral edges and the longitudinal edges, the outer plate also has internal stiffening of a hexagonal pattern, 21*a*, similar to a honeycomb. The internal stiffening has a high strength to weight ratio so that it supports a load with the least weight of materials necessary. The internal stiffening also limits the deflection of each plate when under load. The internal stiffening has a regular pattern encased within an outer wrapping, coating, sleeve, and the like that presents a smooth surface for use.

Figure 16B:
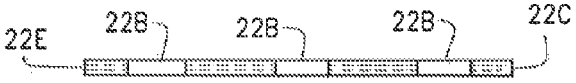
FIG. 16B provides a side view of the outer plate.

Turning the outer plate onto a longitudinal edge, FIG. 16*b* shows a side view of the center plate with the notches 21*b* in the foreground. This view shows the notched longitudinal edge with the greater length of from a notch to a lateral edge to the right. The outside bore 22*e* extends along the longitudinal edge from the left to the right but does not extend towards the lateral edge on the right. Effectively, the outer axle inserts into the outside bore from the left only in this figure.

Figure 16C:
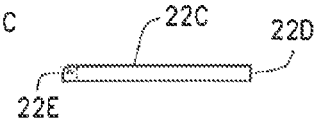
FIG. 16C provides a rear view of the outer plate.

And FIG. 16C shows an end view of the outer plate with the lateral edge 22*c* towards the foreground and the not full length outside bore 22*e* shown in phantom in the foreground. Towards one longitudinal edge only, the outer plate has its one outside bore 22*e* here shown on end. This end view shows the outer plate having a width much greater than its thickness, similar to the center plate and the inner plate.

Figure 17A:
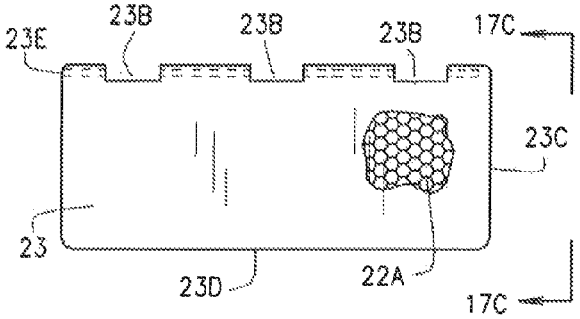
FIG. 17A describes a top view of the inner plate of the present invention.

Then FIG. 17A describes a top view of the inner plate 23 of that name for its inner position between the three plates when folded. The inner plate also has a generally rectangular form with two mutually parallel, spaced apart, shorter lateral edges 23*c* and two mutually parallel, spaced apart, longitudinal edges 23*d*. The longitudinal edges are perpendicular to the lateral edges. Only one longitudinal edge has three notches 23*b* equally spaced about the center of the three notches. This longitudinal edge, slightly inwardly, has an outside hole 22*e* bored substantially through it. The inside hole receives an outer axle through one lateral edge and along the longitudinal edge but not through the second lateral edge. The opposite longitudinal edge has a smooth appearance and no notches and no holes. The outer plate has a greater length of longitudinal edges towards the right of the figure, where the outer hole ends short of the lateral edge as shown. Within the lateral edges and the longitudinal edges, the outer plate also has internal stiffening of a hexagonal pattern, 21*a*, akin to a honeycomb. The internal stiffening has a high strength to weight ratio so that it supports a load with the least weight of materials necessary. The internal stiffening also limits the deflection of each plate when under load. The internal stiffening has a regular pattern encased within an outer wrapping, coating, sleeve, and the like that presents a smooth surface for use.

Figure 17B:
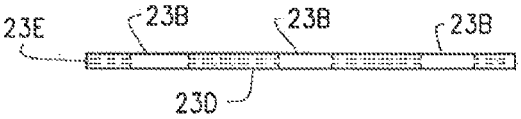
FIG. 17B describes a side view of the inner plate.

Turning the outer plate onto a longitudinal edge, FIG. 17*b* shows a side view of the center plate with the notches 23*b* in the foreground. This view shows the notched longitudinal edge with the greater length of from a notch to a lateral edge to the right. The outside bore 22*e* extends along the longitudinal edge from the left to the right but does not extend towards the lateral edge on the right. Effectively, the outer axle inserts into the outside bore from the left only in this figure.

Figure 17C:
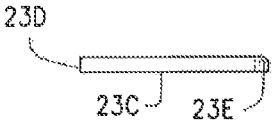
FIG. 17C describes a rear view of the inner plate.

And FIG. 17C shows an end view of the inner plate with the lateral edge 23*c* towards the foreground and the not full length outside bore 22*e* shown in phantom in the foreground. Towards one longitudinal edge only, the outer plate has its one outside bore 22*e* here shown on end. This end view shows the inner plate having a width much greater than its thickness, however the width of the inner plate is slightly less than that of the outer plate so that the inner plate nests beneath the outer plate for a compact cross section of the table when folded.

Figure 18A:
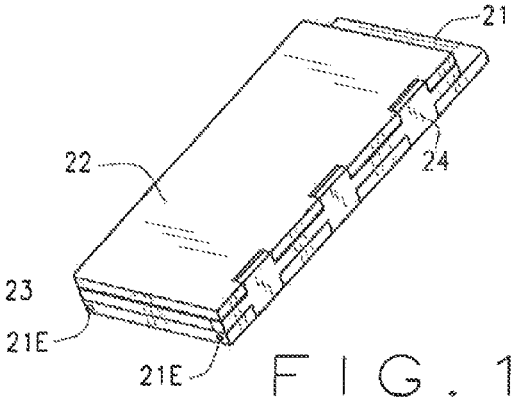
FIG. 18A illustrates a perspective view of the table in the closed position.

The table when folded appears in FIG. 18A with the outer plate 22 shown stacked upon the top of the folded table. Beneath the outer plate, the inner plate 23 fits upon the center plate. The center plate defines the width of the folded table and the maximum length shown here where the center plate extends outwardly from the lateral edges upon one common end of the outer plate and the inner plate. Towards the right in this figure, the long spine 24 has its hinged connection to the center plate and to the outer plate. The long spine has its thinner portions with a generally square shape. This shape allows the outer plate to unfold from the center plate but remain coplanar with the center plate when fully unfolded, see FIG. 7. The longitudinal edge of the outer plate abuts the long spine and the abutting surfaces prevent the longitudinal outer plate from rotating past 180 degrees relative to the center plate. In an alternate embodiment, building on FIGS. 14, 18A, the center plate, the outer plate and the inner plate have thicknesses that taper from proximate the three apertures 21A outwardly to the flush lateral edges of the three plates. The thickness at the flush lateral edges is less than that proximate the three apertures.

Figure 18B:
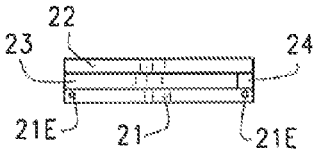
FIG. 18B illustrates a front view of the table in the closed position.

FIG. 18B then shows an end view of the table 20 when folded. The folded table has the center plate 21, then the inner plate 23 upon it, and then the outer plate 22 upon the inner plate. The outer plate has its hinged connection to the center plate shown on the right through the long spine 24, here shown with a thin section, square, towards the foreground. The long spine turns upon both the inner axle and the outer axle. Opposite the outer plate, the inner plate has its hinged connection to the center plate, on the opposite longitudinal edge as the outer plate. The inner plate rotates upon the short spines 28 previously shown in FIG. 14 and upon the inner axle and the outer axle. This end view shows the two inside bores 21*e* of the center plate thus indicating an end view of the lateral edges opposite the length of the center plate extending beyond the other two plates. In an alternate embodiment, the thickness at the flush lateral edges shown in this figure is less than that thickness of the opposite lateral edges, that is, proximate the three apertures.

Figure 19:
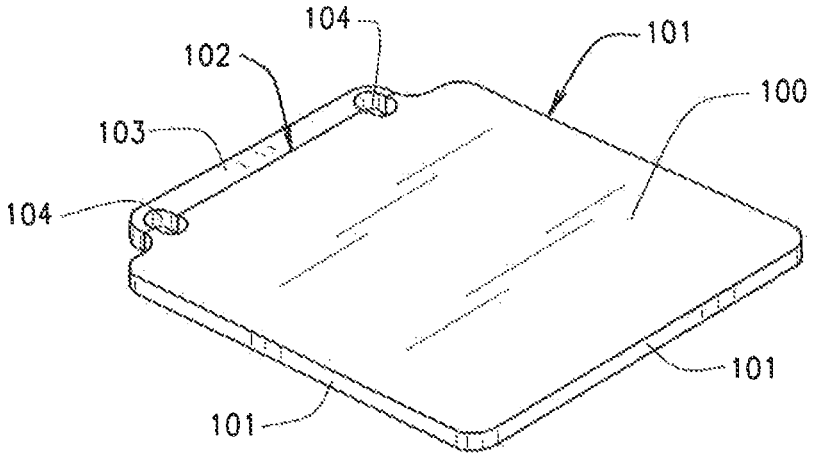
FIG. 19 provides a perspective view of an alternate embodiment of the invention.

Turning to FIG. 19, an alternate embodiment of the invention appears as a portable plate 100. The plate has a generally planar, thin, rectangular shape, preferably square, with three edges 101. Upon the typical fourth edge, the plate has a second edge 102 that receives a clip 103. The clip in cooperation with the second edge provides two spaced apart apertures 104 that admit a pole P of a handle assembly H, not shown. The clip has similar thickness as the second edge. In this alternate embodiment, the plate has a greater thickness at the second edge and then the thickness decreases outwardly toward the other three edges 101, particularly towards that edge opposite the second edge. In a further alternate embodiment, the clip has similar thickness as the remainder of the plate.

Figure 20:
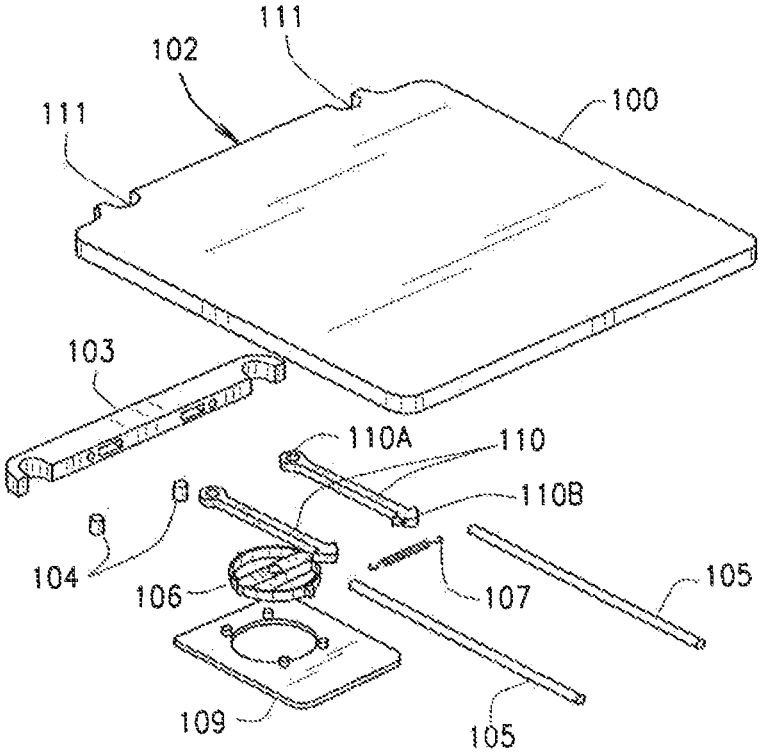
FIG. 20 provides an exploded view of the alternate embodiment of the invention.

FIG. 20 then shows the portable plate 100 in an exploded view showing a mechanism for grasping and securing the clip 103 to the plate. The mechanism includes two clip claws 110, two clip rods, a lock knob 106, a spring 107 or biasing member, an under plate 108, and two caps 109. The clip claws are generally thin, slender, elongated members with a rounded end 110*a* having a hole and an opposite end having a point 110*b*. The clip rods have a thin, slender, round cylindrical shape. The lock knob engages the clip rods as later shown. The caps engage the clip claws so that the claws remain connected into the clip. The clip itself has two spaced apart notches 110 that cooperate with other notches 111 upon the second edge 102 of the plate 100. The clip's notches 112 cooperate with the plate's notches 111 to form the apertures 104 thus allowing the plate to grasp the poles P. Each of the clip's notches receives an insert of an exterior shape compatible to the shape of the clip's notches as shown. The insert has an interior shape that cooperates with the exterior shape of a pole P. This alternate embodiment provides a plurality of inserts with a similar exterior shape but with different interior shape to correspond with pole shapes of various brands of luggage and of handle assembly. The insert has a generally elongated form like a cylindrical sectioned in half vertically. In an alternate embodiment, the insert has a cylindrical form that slips over a pole.

Figure 21:
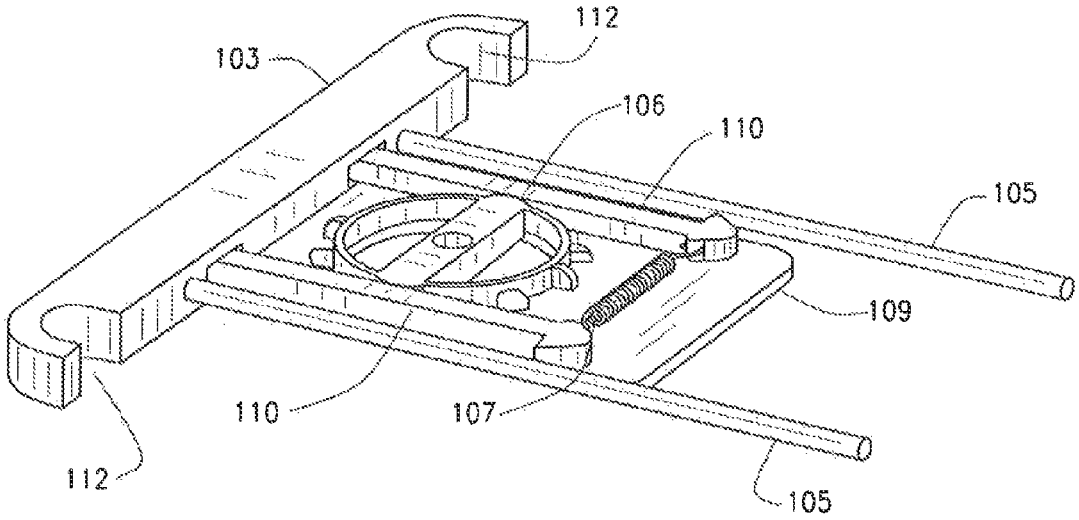
FIG. 21 provides a detailed view of the alternate embodiment of the invention.

FIG. 21 shows a perspective view of the clip mechanism assembled. The clip claws 104 secure into the clip 103 so that both clip claws move together as the rods 105 slide into the plate as later described. The lock knob 106 spreads the pointed ends of the clip claws outward when turned and the spring 107 brings the pointed ends of the clip claws closer when the lock knob turns in the opposite direction. The underplate 106 spans beneath the lock knob and provides a pivot for the knob.

Figure 22:
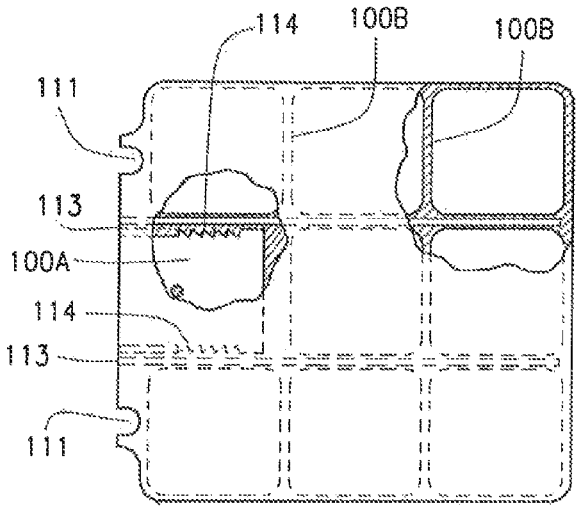
FIG. 22 provides a top view of the of the alternate embodiment of the invention.

Having mentioned the rods, FIG. 22 shows a bottom view of the plate 100 which portions made transparent. The plate generally has a pattern of ribs 100*b* forming generally nine chambers within a top surface and a bottom surface. The chambers have a three by three pattern of generally similar size. Towards the second edge 102 of the plate, two chambers abut the other notches 111 and one centered chamber 100*a* receives the clip mechanism. This centered chamber opens to the second edge and along two of its ribs it has plate holes bored in them as at 113. The plate holes continue perpendicular to the second edge and along the nine chambers but do not penetrate the edge 101 opposite the second edge. This edge would be furthest from the poles P upon installation of the plate. Returning to the second chamber, just inwardly from the plate holes 113, the second chamber has two mutually spaced apart racks 114 of teeth. The racks extend for a portion of the length of the second chamber so that the teeth may engage the pointed ends of the clip claws as previously described. The racks with their teeth patterns accommodate various amounts of insertion of the clip mechanism for various thicknesses of pole P. The underplate then merges with the remaining bottom surface of the plate.

Figure 23:
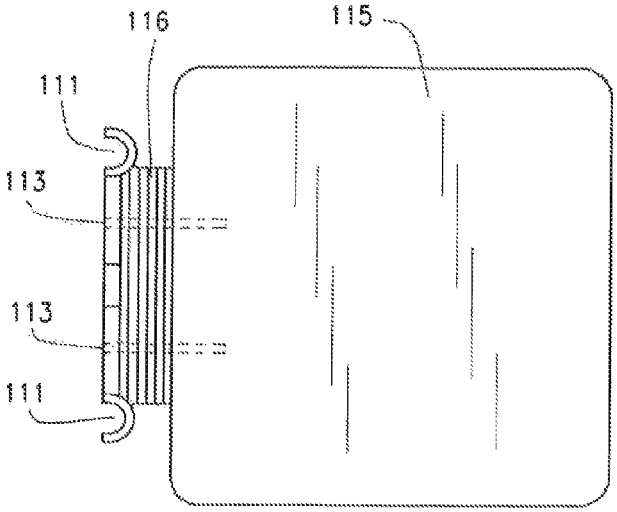
FIG. 23 shows a top view of a further alternate embodiment of the invention; and, FIG. 24 shows a perspective view of the alternate embodiment of the present invention.

FIG. 23 then shows another alternate embodiment of the plate 115 from the top view. This plate has a rectangular form, typically square with three edges 101 as before. The second edge in this embodiment has a neck 116 that extends outwardly from the plate. The neck has a generally rectangular shape of thin planar cross section and has a plurality of ridges 116*a* for stiffening. The neck then has a free edge away from the plate that extends outwardly and has wings that contain the other notches 111. These other notches then cooperate with the notches on the clip for containing poles as described for FIGS. 20-22. The bottom view of this plate is similar to that of FIG. 22.

Figure 24:
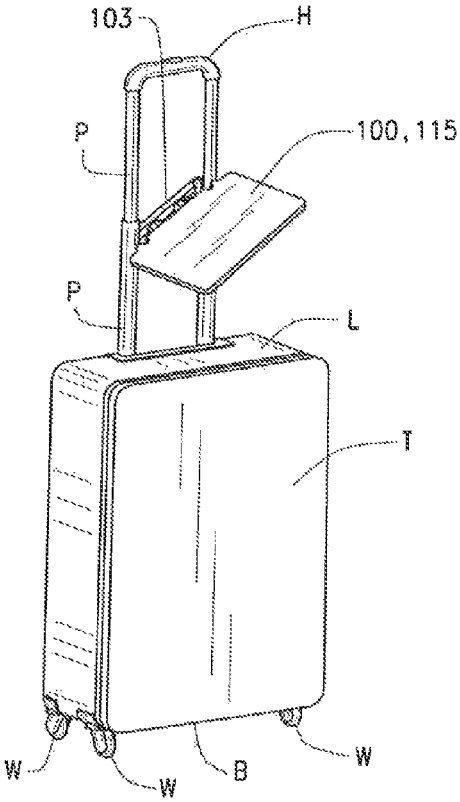

And, FIG. 24 then shows installation of a plate 110, or its alternate 115, upon poles P of a handle assembly H. A user gently places the clip 103 so that the clip mechanism loosely engages the centered chamber of the plate 110, 115. The user then tilts the clip so it fits between the poles and then tilts the clip further so the notches 110 of the clip wrap behind the poles and the notches 111 of the plate wrap in front of the poles. The poles then pass upon the apertures 104 of the plate until the plate attains a desired elevation and the user advances the clip into the plate. The clip claws then engage the racks of teeth until the user later turns the lock knob in the opposite direction to disengage the clip mechanism.

It should be understood that the foregoing relates to exemplary embodiments of the invention and that modifications may apply to the invention without departing from the spirit and scope of the invention as set forth in the claims that follow.

From the aforementioned description, a portable tray for luggage has been described. The portable tray for luggage is uniquely capable of stowing a table within the space of a handle assembly, locating the table at a selected elevation, extending that table as a cantilever from the handle assembly, and then unfolding that table into a flat surface. The portable tray for luggage has an adjustable height support assembly, a ratchet assembly with at least two orientations, and a table of plates upon double hinges that folds into a compact shape. The portable tray for luggage and its various components may be manufactured from many materials, including but not limited to, textiles, polyester, carbon fiber, steel, aluminum, brass, bronze, polymers, polyvinyl chloride, high density polyethylene, polypropylene, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

While the present invention has description above of its preferred embodiment, it will be understood that it is not intended to limit the invention to these embodiments. Instead, it is intended to cover all alternatives, modifications and equivalents as may be included within the spirit and scope of the present invention as defined by the appended claims.

I claim:

1. A device providing a tray upon a handle assembly of luggage, the handle assembly extending outwardly from the luggage generally perpendicular to a supporting surface, the device comprising:

a support assembly adapted to slidingly engage the handle assembly;

a ratchet assembly cooperatively joined to the support assembly;

a table cooperatively connected to said support assembly;

a storage sleeve adapted to install within the handle assembly within the luggage, said storage sleeve having a volume to contain said table and said ratchet assembly;

said device having a stowed position when contained in said storage sleeve, a rest position when withdrawn from said storage container above the luggage, a cantilevered position when said table rotates outwardly from said support assembly wherein said table extends generally parallel to the supporting surface, and an unfolded position wherein said table has its greatest surface area;

said support assembly adapted to engage by friction the handle assembly at an elevation above the supporting surface selected by a user;

said ratchet assembly having a flat orientation generally parallel to the supporting surface and at least two angled orientations; and, said table having three plates that unfold into a common planar shape.

2. The portable tray for luggage of claim 1 further comprising:

said support assembly having two spaced apart supports oriented in the same direction, a crossbar joining to said supports, and two stops, each of said stops inserting into one of said supports;

wherein said stops are adapted to enwrap a pole of the handle assembly and wherein said stops are adapted to frictionally engage the pole upon movement of said stop inwardly in said support.

3. The portable tray for luggage of claim 2 further comprising:

each of said supports having a generally hollow, truncated conical form, an upper end and an opposite lower end, a length between said lower end and said upper end, a chamber tapering from proximate said lower end to said upper end, a slot in said support above said lower end and away from said upper end;

said crossbar having a centered aperture therein, said crossbar joining to each of said supports above said slot, each of said slots being oriented outwardly from said crossbar;

each of said stops having a thin walled, generally hollow, truncated form, an upper end and an opposite lower end, a length between said lower end and said upper end, said length being less than the length of said support, a slit spanning between said lower end and said upper end, a grip generally opposite said slit;

each of said stops inserting its upper end into the lower end of each of said supports, each of said grips then inserting into said slot of each of said supports;

wherein upon a user moving said grip upwardly, said slit closes as said stop narrows within said chamber and thus said stop in cooperation with said support is adapted to grasp a pole of the handle assembly at a desired elevation.

4. The portable tray for luggage of claim 3 further comprising:

each of said supports having generally cylindrical base proximate said lower end and opposite said slot thus orienting inwardly, a ratchet of generally cylindrical form coaxial with said base of lesser diameter than said base, and a pin of generally cylindrical form coaxial with said ratchet of lesser diameter than said base; and, said ratchet having at least two teeth including a first tooth separated at least ninety two degrees of rotation from a second tooth wherein said table rotates from its rest position in coordination with said first tooth to its cantilevered position in coordination with said second tooth.

5. The portable tray for luggage of claim 4 further comprising:

each of said ratchets including a third tooth and a fourth tooth proximate said second tooth.

6. The portable tray for luggage of claim 1 further comprising:

said ratchet assembly having two covers, two casings upon said covers, a clip claw upon each cover, a mounting pin upon each cover and receiving said clip claw, a clip spring upon each cover operatively connecting to said clip claw wherein said clip spring biases said clip claw inwardly;

each of said covers connecting to said table; and, said ratchet assembly having a center plate connecting to said covers, a ratchet spring upon said center plate, a release button upon said ratchet spring operatively engaging each of said clip claws, a back cover outwardly of said release button and admitting a portion of said release button for a user to press.

7. The portable tray for luggage of claim 6 further comprising:

said center plate having a generally elongated prismatic form with two opposite ends and a center face spanning between the two ends, said center face having a greater thickness than the remainder of said center plate;

each of said casings having an elongated rectangular form with a rounded end, said rounded end being hollow to receive said clip claw, said clip spring, and said mounting pin, inwardly from said rounded end, said casing having a square edge abutting said center face, said rounded end having an aperture for communication to said clip claw;

said release button having a generally flat rectangular form, with two spaced apart collinear tips and a release knob centered between said tips, said tips extending into said apertures of said rounded ends of said casings wherein said tips operatively engage said clipclaw; and, each of said covers having a generally flat rectangular shape with a rounded end in registration to the rounded end of each of said casings.

8. The portable tray for luggage of claim 1 further comprising:

said table having a center plate hingedly connecting to an outer plate and said center plate hingedly connecting to an inner plate;

said center plate having a generally rectangular form with a thin cross section, two spaced apart longitudinal edges and two mutually parallel and spaced apart lateral edges, said lateral edges of lesser length than said longitudinal edges and perpendicular to said longitudinal edges, each of said longitudinal edges having at least two notches thereon, each of said longitudinal edges having an axial inside bore extending from one lateral edge but short of the other lateral edge;

said inner plate having a generally rectangular form with a thin cross section, two spaced apart longitudinal edges and two mutually parallel and spaced apart lateral edges, said lateral edges of lesser length than said longitudinal edges and perpendicular to said longitudinal edges, one of said longitudinal edges having at least two notches thereon, said longitudinal edge having said at least two notches having an axial outside bore extending from one lateral edge but short of the other lateral edge, said at least two notches aligned with the at least two notches on one of the longitudinal edges of said center plate;

said outer plate having a generally rectangular form with a thin cross section, two spaced apart longitudinal edges and two mutually parallel and spaced apart lateral edges, said lateral edges of lesser length than said longitudinal edges and perpendicular to said longitudinal edges, one of said longitudinal edges having at least two notches thereon, said longitudinal edge having said at least two notches having an axial outside bore extending from one lateral edge but short of the other lateral edge, said at least two notches aligned with the at least two notches on the other of the longitudinal edges of said center plate;

said inner plate and said outer plate having a lesser length than said center plate;

wherein said inner plate folds upon said center plate and said outer plate folds upon said inner plate so that the longitudinal edges of all plates are flush and the lateral edges with bores of all plates are flush.

9. The portable tray for luggage of claim 8 further comprising:

said outer plate connecting to said center plate upon a double hinge, said double hinge including a long spine having thin portions of square cross section between wide portions of rectangular shape, said wide portions having axial holes therein aligning with said inside bore of said center plate and said outside bore of said outer plate and an inner axle inserted into said inside bore and an outer axle inserted into said outside bore wherein upon opening said outer plate from said center plate, said outer plate is coplanar with said center plate; and, said inner plate connecting to said center plate upon a double hinge, said double hinge including at least two short spines having a rectangular shape with rectangular cross section, having parallel axial holes therein aligning with said inside bore of said center plate and said outside bore of said inner plate and an inner axle inserted into said inside bore and an outer axle inserted into said outside bore wherein upon opening said inner plate from said center plate, said inner plate is coplanar with said center plate.

10. The portable tray for luggage of claim 8 wherein said center plate, said outer plate, and said inner plate have stiffening therein of a generally honeycomb pattern.

11. A device providing a tray upon a handle assembly of luggage, the handle assembly extending outwardly from the luggage generally perpendicular to a supporting surface, the device comprising:

a table having a center plate connecting to an outer plate upon a double hinge and said center plate connecting to an inner plate upon a double hinge, wherein upon unfolding said outer plate from said inner plate, said inner plate, said outer plate, and said center plate are coplanar, wherein upon folding said inner plate upon said center plate and said outer plate upon said inner plate, said outer plate and said inner plate are flush with said center plate;

a ratchet assembly cooperatively joined to said center plate wherein said ratchet assembly rotates said table up to ninety five degrees;

a support assembly adapted to slidingly engage the handle assembly;

a storage sleeve adapted to install within the handle assembly within the luggage, said storage sleeve having a volume to contain said table and said ratchet assembly;

said device having a stowed position when contained in said storage sleeve, a rest position when withdrawn from said storage container above the luggage, a cantilevered position when said table rotates outwardly from said support assembly wherein said table extends generally parallel to the supporting surface, and an unfolded position wherein said table has its greatest surface area;

said support assembly adapted to engage by friction the handle assembly at an elevation above the supporting surface selected by a user; and, said ratchet assembly having a flat orientation generally parallel to the supporting surface and at least two angled orientations.

12. The portable tray for luggage of claim 11 further comprising:

said center plate having a generally rectangular form with a thin cross section, two spaced apart longitudinal edges and two mutually parallel and spaced apart lateral edges, said lateral edges of lesser length than said longitudinal edges and perpendicular to said longitudinal edges, each of said longitudinal edges having at least two notches thereon, each of said longitudinal edges having an axial inside bore extending from one lateral edge but short of the other lateral edge;

said inner plate having a generally rectangular form with a thin cross section, two spaced apart longitudinal edges and two mutually parallel and spaced apart lateral edges, said lateral edges of lesser length than said longitudinal edges and perpendicular to said longitudinal edges, one of said longitudinal edges having at least two notches thereon, said longitudinal edge having said at least two notches having an axial outside bore extending from one lateral edge but short of the other lateral edge, said at least two notches aligned with the at least two notches on one of the longitudinal edges of said center plate;

said outer plate having a generally rectangular form with a thin cross section, two spaced apart longitudinal edges and two mutually parallel and spaced apart lateral edges, said lateral edges of lesser length than said longitudinal edges and perpendicular to said longitudinal edges, one of said longitudinal edges having at least two notches thereon, said longitudinal edge having said at least two notches having an axial outside bore extending from one lateral edge but short of the other lateral edge, said at least two notches aligned with the at least two notches on the other of the longitudinal edges of said center plate;

said inner plate and said outer plate having a lesser length than said center plate; and, wherein said inner plate folds upon said center plate and said outer plate folds upon said inner plate so that the longitudinal edges of all plates are flush and the lateral edges with bores of all plates are flush.

13. The portable tray for luggage of claim 12 further comprising:

said double hinge of said outer plate including a long spine having thin portions of square cross section between wide portions of rectangular shape, said wide portions having axial holes therein aligning with said inside bore of said center plate and said outside bore of said outer plate and an inner axle inserted into said inside bore and an outer axle inserted into said outside bore wherein upon opening said outer plate from said center plate, said outer plate is coplanar with said center plate; and, said double hinge of said inner plate including at least two short spines having a rectangular shape with rectangular cross section, having parallel axial holes therein aligning with said inside bore of said center plate and said outside bore of said inner plate and an inner axle inserted into said inside bore and an outer axle inserted into said outside bore wherein upon opening said inner plate from said center plate, said inner plate is coplanar with said center plate.

14. The portable tray for luggage of claim 11 further comprising:

said ratchet assembly having two covers, two casings upon said covers, a clip claw upon each cover, a mounting pin upon each cover and receiving said clip claw, a clip spring upon each cover operatively connecting to said clip claw wherein said clip spring biases said clip claw inwardly;

each of said covers connecting to said center plate of said table; and, said ratchet assembly having a center plate connecting to said covers, a ratchet spring upon said center plate, a release button upon said ratchet spring operatively engaging each of said clip claws, a back cover outwardly of said release button and admitting a portion of said release button for a user to press.

15. The portable tray for luggage of claim 14 further comprising:

said center plate of said ratchet assembly having a generally elongated prismatic form with two opposite ends and a center face spanning between the two ends, said center face having a greater thickness than the remainder of said center plate;

each of said casings having an elongated rectangular form with a rounded end, said rounded end being hollow to receive said clip claw, said clip spring, and said mounting pin, inwardly from said rounded end, said casing having a square edge abutting said center face, said rounded end having an aperture for communication to said clip claw;

said release button having a generally flat rectangular form, with two spaced apart collinear tips and a release knob centered between said tips, said tips extending into said apertures of said rounded ends of said casings wherein said tips operatively engage said clipclaw; and, each of said covers having a generally flat rectangular shape with a rounded end in registration to the rounded end of each of said casings.

16. The portable tray for luggage of claim 11 further comprising:

said support assembly having two spaced apart supports oriented in the same direction, a crossbar joining to said supports, and two stops, each of said stops inserting into one of said supports;

wherein said stops are adapted to enwrap a pole of the handle assembly and wherein said stops are adapted to frictionally engage the pole upon movement of said stop inwardly in said support.

17. The portable tray for luggage of claim 16 further comprising:

each of said supports having a generally hollow, truncated conical form, an upper end and an opposite lower end, a length between said lower end and said upper end, a chamber tapering from proximate said lower end to said upper end, a slot in said support above said lower end and away from said upper end;

said crossbar having a centered aperture therein, said crossbar joining to each of said supports above said slot, each of said slots being oriented outwardly from said crossbar;

each of said stops having a thin walled, generally hollow, truncated form, an upper end and an opposite lower end, a length between said lower end and said upper end, said length being less than the length of said support, a slit spanning between said lower end and said upper end, a grip generally opposite said slit;

each of said stops inserting its upper end into the lower end of each of said supports, each of said grips then inserting into said slot of each of said supports;

wherein upon a user moving said grip upwardly, said slit closes as said stop narrows within said chamber and thus said stop in cooperation with said support is adapted to grasp a pole of the handle assembly at a desired elevation.

18. The portable tray for luggage of claim 17 further comprising:

each of said supports having generally cylindrical base proximate said lower end and opposite said slot thus orienting inwardly, a ratchet of generally cylindrical form coaxial with said base of lesser diameter than said base, and a pin of generally cylindrical form coaxial with said ratchet of lesser diameter than said base; and, said ratchet having a first tooth separated from at least one additional tooth, said first tooth being at least ninety two degrees of rotation ahead from said at least one additional tooth wherein said table rotates from its rest position in coordination with said first tooth to its cantilevered position in coordination with said at least one additional tooth.

19. The portable tray for luggage of claim 11 wherein said center plate, said outer plate, and said inner plate have stiffening therein of a generally honeycomb pattern.

20. A device providing a tray readily placed upon a handle assembly of luggage and then readily removed, the handle assembly extending outwardly from the luggage generally perpendicular to a supporting surface, the device comprising:

a plate, generally rectangular with two mutually parallel and spaced apart first edges, another first edge perpendicular to the mutually parallel first edges, a second edge perpendicular to the mutually parallel first edges and spaced apart from the other first edge, said second edge having two spaced apart notches;

a clip, generally elongated, having two spaced apart notches in registration with the notches upon said second edge, said clip connecting with said second edge;

said second edge leading into a first chamber within said plate, said first chamber having a generally rectangular shape, two spaced apart racks of teeth extending inwardly from said second edge, two bore holes outwardly from said racks and extending inwardly from said second edge;

said clip having two mutually parallel and spaced apart clip rods inwardly from said notches extending opposite said notches, two mutually spaced apart clip claws inward from said clip rods and extending similarly to said clip rods, said clip claws pivotally connecting to said clip, said clip claws having an elongated thin shape with a rounded end proximate said clip and a pointed end opposite said clip, a lock knob engaging said clip claws, a spring connecting said pointed ends of both clip claws wherein rotation of said lock knob moves said pointed ends inwardly and outwardly within said first chamber, and an underplate beneath said lock knob and said spring extending back to said clip, said underplate merging with said plate; and, said plate having at least one thickness.

* * * * *